US005083753A

United States Patent [19]

Soofi

[11] Patent Number: 5,083,753

[45] Date of Patent: Jan. 28, 1992

[54] TUNDISH BARRIERS CONTAINING PRESSURE DIFFERENTIAL FLOW INCREASING DEVICES

[75] Inventor: Madjid Soofi, St. Charles, Ill.

[73] Assignee: Magneco/Metrel, Addison, Ill.

[21] Appl. No.: 680,889

[22] Filed: Apr. 5, 1991

Related U.S. Application Data

[63] Continuation of Ser. No. 564,903, Aug. 6, 1990, abandoned.

[51] Int. Cl.[5] ..... C21C 5/48

[52] U.S. Cl. ..... 266/229; 266/275

[58] Field of Search ..... 266/217, 220, 227, 228, 266/229, 230, 287, 235; 222/594, 603

[56] References Cited

U.S. PATENT DOCUMENTS

| | | | |
|---|---|---|---|
| 4,573,664 | 3/1986 | Prendergast | 266/230 |
| 4,667,939 | 5/1987 | Luyckx | 266/287 |
| 4,940,489 | 7/1990 | Cummings | 266/227 |

*Primary Examiner*—S. Kastler

*Attorney, Agent, or Firm*—John G. Premo

[57] ABSTRACT

Nozzles positioned in the bottom portion of tundish barriers, such as baffles, improve the flow of molten metal in the tundish.

4 Claims, 2 Drawing Sheets

TUNDISH BARRIERS CONTAINING PRESSURE DIFFERENTIAL FLOW INCREASING DEVICES

This application is a continuation of application Ser. No. 564,903, filed Aug. 6, 1990, now abandoned.

FIELD OF THE INVENTION

The present invention is related to barriers and particularly baffles for controlling the flow of the molten metal in tundishes.

BACKGROUND OF THE INVENTION

During the continuous casting of steel, molten metal is transferred from large ladles to intermediate pouring vessels called tundishes. From these tundishes, the metal is poured into ingots, or other molds, to cast the molten metal.

While in the tundishes, the molten steel will not always have sufficient residence time to allow non-metallic inclusions to become separated from the liquid metal. This generally occurs when the metal is quickly transferred from the tundishes to the molds from which the continuously cast steel is formed.

Impurities entrained in the metal may affect the final cast product. Processing of the metal may be thereby hampered, or the finished product may be less pure, less structurally sound or may have poor finishing quality due to its anodizing characteristics. These impurities may originate from several sources. For example, impurities may include metallic impurities such as alkaline and/or alkaline earth metals, dissolved entrained gas and occluded tundish surface oxide films which have broken up in the molten metal. In addition, inclusions may originate as insoluble impurities such as carbides or borides and eroded furnace and trough refractories.

When these non-metallic inclusions do become separated, their lower density allows them to rise to the top of the tundish in the form of slag. This slag is then skimmed from the molten metal. It is therefore desirable to remove these inclusions while residing in the tundishes.

It is therefore desirable to increase the residence time of the metal in the tundish. This allows the metal to settle enough for entrained gases and non-metallic inclusions to be removed in the form of slag.

It is also desirable to form the tundish in a shape that maintains a relatively homogeneous temperature throughout the interior surface of the tundish. In other words, it is undesirable to have molten metal occupying "dead zones" in the tundish where the molten metal does not circulate. Dead zones result in a less homogeneous metal, and also reduce the effective capacity of the tundish, since some of the metal will remain in the tundish for an excessively long time.

In order to improve the circulation of the molten metal and also increase residence time, tundishes have been developed in which the molten metal flow is diverted using barriers. These barriers are usually, but not necessarily, substantially rectangular in shape. They extend between the tundish walls in a direction which is transverse to the metal flow between the metal entry and exit points.

One type of barrier, commonly called a weir, is located in the upper part of the tundish. The weir prevents liquid metal from flowing continuously across the surface of the molten metal, while allowing liquid flow beneath the weir. Another type of barrier, commonly called a dam, is located in the lower part of the tundish, typically protruding from the tundish floor. In a tundish equipped with a dam, the flow of liquid metal is directed to move over the top of the dam. Dams and weirs may be used together in order to produce a desired liquid metal flow pattern.

A preferred barrier are baffles which is configured similarly to the weirs or dams previously described. The baffles compartmentalize a tundish into an inlet and outlet side and contain, below the normal liquid level of the steel present in the tundish, a plurality of holes. The molten steel flowing through the holes positioned in the baffle, which in certain instances are angled to provide a good flow pattern, substantially increase the uniformity of temperature of the steel and also provide a good flow pattern which tends to diminish dead zones.

SUMMARY OF THE INVENTION

The present invention comprises a ceramic barrier of the type used to promote the circulation of steel in a tundish which has located in its lower half one or more pressure differential flow increasing devices. In a preferred embodiment, the barrier is a baffle.

A preferred baffle, which contains a pressure differential flow increasing device in its bottom half, is formed from a relatively thin refractory plate containing a number of holes, which are preferably about four inches in diameter. The holes are arranged across the baffle with two rows of holes located at a height midway up the baffle. These holes are formed with their axes generally parallel to the flow path of the molten metal (i.e., perpendicular to the plant of the baffle surface). Two additional rows of holes in the baffle are formed at 45° angles to the flow path (i.e., 45° to the baffle surface). These rows or angled holes are placed near the bottom of the baffle and below the first set of holes. Finally, porous media is provided in the baffle for the injection of gases into the molten metal.

BRIEF DESCRIPTIONS OF THE DRAWINGS

In the drawings like parts have like numbers.

DETAILED DESCRIPTION OF A PREFERRED EMBODIMENT

Figure 1:
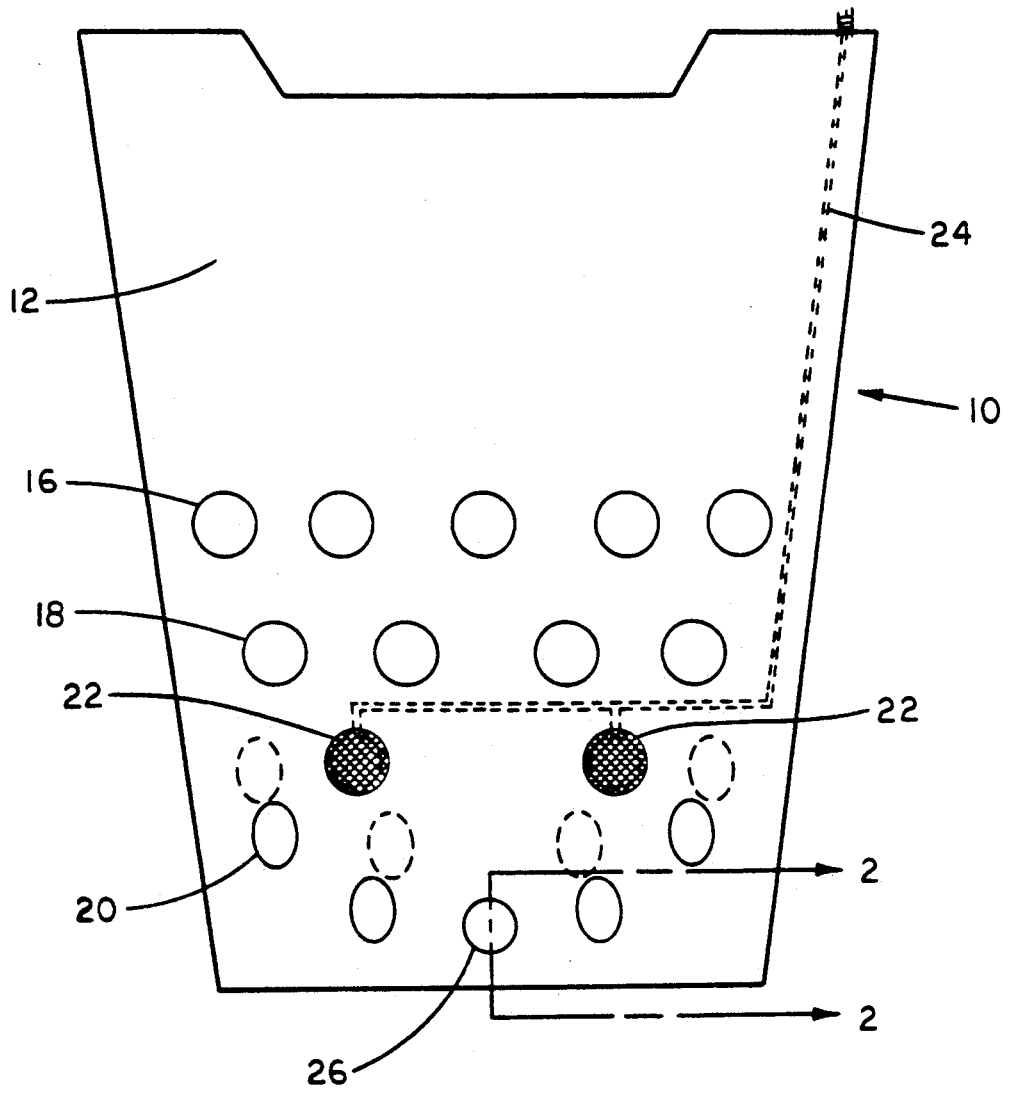
FIG. 1 is a back vertical view of a tundish baffle made in accordance with the teachings of the invention.
Figure 2:
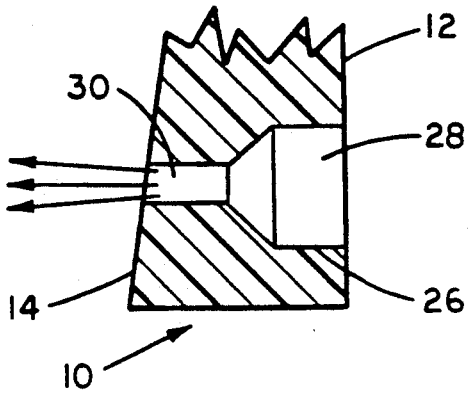
FIG. 2 is an enlarged, partial side view taken across the lines 2—2 of FIG. 1.

As shown in FIGS. 1 and 2 is baffle 10 having a back face 12 and a front face 14. The normal direction of flow is from back face towards the front face. This flow is shown in FIG. 2 with arrows. The baffle contains, approximately positioned in its lower half, two rows of perpendicular holes designated by the numerals 16 and 18. These holes extend horizontally through the front and back faces of the baffle. The metal being poured into the back portion of a tundish to flow through these holes into the front portion of the tundish which faces the front side 14 of the baffle 10.

The upper rows of perpendicular holes 16 are formed with five holes across the baffle 10. This row is placed about midway along the height of the baffle.

The perpendicular holes 18 are placed vertically about midway between the vertical position of each of the holes in row 16. This allows effective coverage of the entire width of the tundish, not shown, into which the baffle would be placed.

The baffle 10 also contains a third row of holes, designated generally by the numeral 20. They are formed along the lower portion of the baffle 10. As shown in FIG. 1, the holes in row 20 are skewed with their longitudinal axes at about a 45° angle with the horizontal base. This angulation maximizes the flow from the back side of the tundish through the holes and through the front face of the tundish 10. The angulation of the holes as shown in FIG. 1 causes the steel to be forced into the tundish toward the center, thus maintaining a constant gentle flow of metal within the tundish to occur. The holes also allow flow of the metal from the sides to the center of the tundish.

In a preferred embodiment with respect to the baffle described in FIGS. 1 and 2, it also includes a porous media 22. There would generally be two media placed about the same height between the rows of holes 18 and 20. An inert gas such as argon would be fed to the porous media through tubular channel 24 to increase circulation.

While the baffles shown in FIGS. 1 and 2 have provided improved results with respect to improving the flow and circulation of metals within tundishes and allowing a uniformity of heat to occur within the tundish, as well as providing for better slag accumulation, nevertheless further improvements have been made by this invention.

The improvement with which the present invention is concerned is the baffle of the type described in FIG. 1 or in other barriers used in tundishes which contain or are fitted with one or more pressure differential flow increasing devices. Such a device is shown in FIG. 2 and is a preferred embodiment. The nozzle 26 is funnel shaped. The back side 28 is wider and gradually tapers to form a narrow outlet shown by the numeral 30. The nozzle replaces the middle hole in row 20 of the baffle previously described above. This is a preferred embodiment. The nozzle, however, may be used in addition to the existing holes in a baffle.

As stated, the pressure differential flow increasing devices are, in a preferred embodiment, located near the bottom of the baffle or barrier. In most cases only one of such devices is sufficient to provide a substantial flow rate into the section of the tundish which faces the outer face portion of the baffle.

The preferred pressure differential flow increasing device is the nozzle as shown in FIG. 2. As shown by the arrows in FIG. 2, the flow produced by this nozzle is substantially linear. Nozzles producing such linear flow patterns are preferred as opposed to those producing expanded flow patterns.

Figure 3:
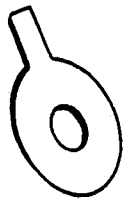
FIG. 3 is a perspective view orifice place which can be used to improve the flow when used in conjunction with the barriers of the invention.
Figure 4:
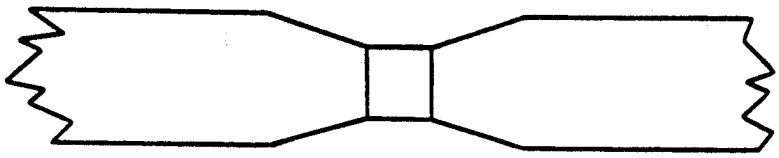
FIG. 4 is a side view illustrating a Venturi tube which can be used in the barriers as an alternate means for increasing flow.

Other pressure differential flow increasing devices are shown in FIGS. 3 and 4. In FIG. 3 there is shown an orifice plate which can be built in or formed into openings positioned in the lower portion of the barriers. Another, yet more difficult to fabricate, pressure differential reducing device shown in FIG. 4 is the well-known Venturi tube. The Venturi would be formed into the barriers by using a plastic or other combustible mold material about which the barrier would be cast. During the high temperature firing of the barrier, which in the case of the alumina is in excess of 2,000° F., the pattern material used to shape the Venturi in the barrier would be burned out.

Any pressure increasing device based on Bernoulli's theorem can be used. Although the invention is described and claimed with respect to molten steel, the term "steel" includes other metals such as copper.

Having thus described my invention, it is claimed as follows:

1. A tundish used to pour molten metals having a bottom and side walls and molten metal entry and exit points which points are separated by a baffle having sides, two faces and an upper and lower half which baffle has its sides positioned between the tundish walls in a position which is transverse to the direction of molten metal flow with the face of the baffle facing the molten metal entry point being its back face and with the face of the baffle facing the molten metal exit point being its front face which baffle has a number of openings extending between its back and front faces and in addition thereto at least one pressure differential flow increasing opening located in the lower half of the baffle which opening has its inlet located in the back face of the baffle which inlet is wider in cross section than the outlet which is located in the front face of the baffle.

2. The tundish of claim 1 where the flow control device in the baffle is a nozzle.

3. The tundish of claim 2 where the nozzle produces a substantially linear flow.

4. The tundish of claim 2 where the nozzle is in the shape of a funnel.

* * * * *